United States Patent [19]

Chow

[11] Patent Number: 4,862,775

[45] Date of Patent: Sep. 5, 1989

[54] CONTROL DEVICE FOR RATCHET WRENCHES

[76] Inventor: Jessie Chow, No. 15-30, Kwangming Rd., Hsi Twen District, Taichung, Taiwan

[21] Appl. No.: 259,844

[22] Filed: Oct. 19, 1988

[51] Int. Cl.[4] ..... B25B 13/46

[52] U.S. Cl. ..... 81/63.2; 192/43.1; 74/151

[58] Field of Search ..... 81/63–63.2; 192/43.1, 43.2, 47; 74/151

[56] References Cited

U.S. PATENT DOCUMENTS

| | | | |
|---|---|---|---|
| 1,816,968 | 8/1931 | Greutman et al. | 81/63 |
| 3,369,416 | 2/1968 | Kilness | 81/63.2 X |
| 4,300,413 | 11/1981 | Garofalo | 81/62 |
| 4,592,255 | 6/1986 | Mayer | 81/63 |
| 4,722,253 | 2/1988 | Chow | 81/63 |

*Primary Examiner*—James G. Smith

*Attorney, Agent, or Firm*—Merchant, Gould, Smith, Edell, Welter & Schmidt

[57] ABSTRACT

A control device for ratchet wrenches, which is disposed in a housing of a wrench, including a resilient sheet, a control element and a button. The resilient sheet is arranged between a pawl of the wrench and the control element. The control element is pivotally disposed in the housing and has an opening to receive the resilient sheet and a groove or notch to receive a pin of the button.

2 Claims, 7 Drawing Sheets

CONTROL DEVICE FOR RATCHET WRENCHES

BACKGROUND OF THE INVENTION

The present invention relates to ratchet wrenches, in particular to a control device for ratchet wrenches which can be easily operated by a user with only one hand.

Ratchet wrenches comprise a housing receiving a ratchet wheel and a control device therein. A conventional control device as shown in FIG. 10 is disposed adjacent to the ratchet wheel in order to control the rotation direction of the ratchet. As is well known, the length of a ratchet wrench is longer than that of a hand, therefore the operator has to use one hand to apply a torque to the wrench and the other hand to operate the control device for changing the direction of rotation of the rotation of the ratchet wheel.

It is the purpose of the present invention, therefore, to mitigate and/or obviate the above-mentioned drawbacks in the manner set forth in the detailed description of the preferred embodiment.

SUMMARY OF THE INVENTION

It is a primary objective of the present invention to provide a control device for ratchet wrenches which comprise a pawl to contact with a ratchet wheel, a control element disposed in the middle of the housing of the ratchet wrench and a resilient sheet engaged between the pawl and the control element. The rotation of the control element forces the resilient sheet to swivel to allow the pawl to selectively rest against the ratchet wheel at the first or second stop tooth in order to control the rotation direction of the ratchet wheel.

It is a further objective of the present invention to provide a control device for ratchet wrenches which comprises a button having a pin with one end engaging with the control element and the other end protruding through the wall of the housing.

Further objectives and advantages of the present invention will become apparent as the following description proceeds, and the features of novelty which characterize the present invention are pointed out with particularity in the claims annexed to and forming a part of this invention.

DETAILED DESCRIPTION OF THE PREFERRED EMBODIMENTS

Figure 1:
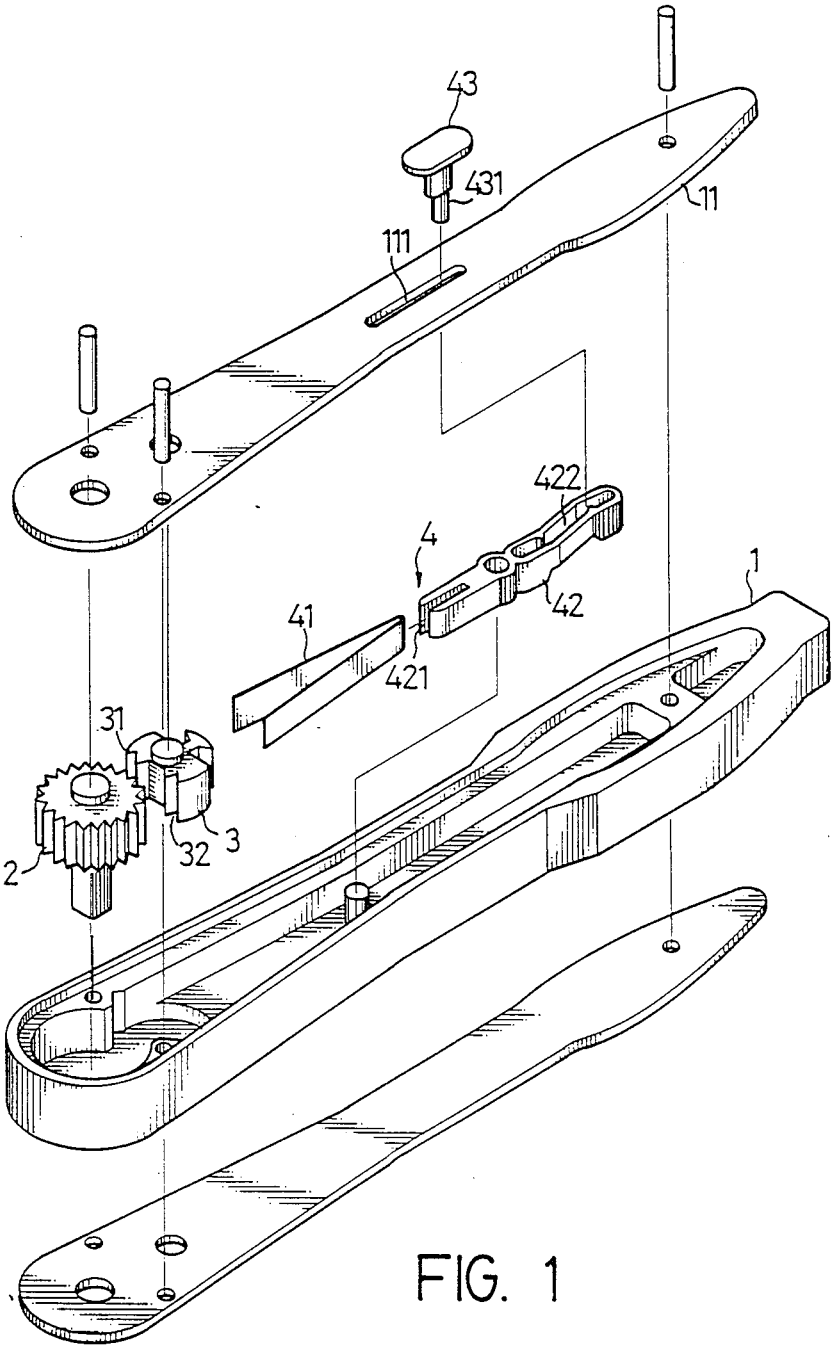
FIG. 1 is an exploded view of a ratchet wrench incorporating control device for a ratchet wrench in accordance with the present invention.
Figure 2:
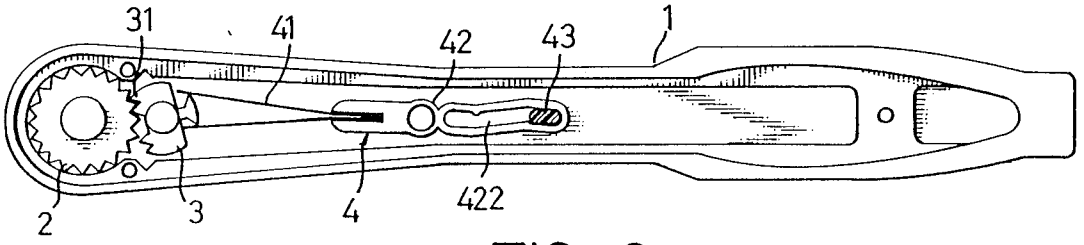
FIG. 2 is a top view of the control device as shown is FIG. 1 showing that the ratchet wheel can only transmit torque in a counterclockwise (CCW) direction.
Figure 3:
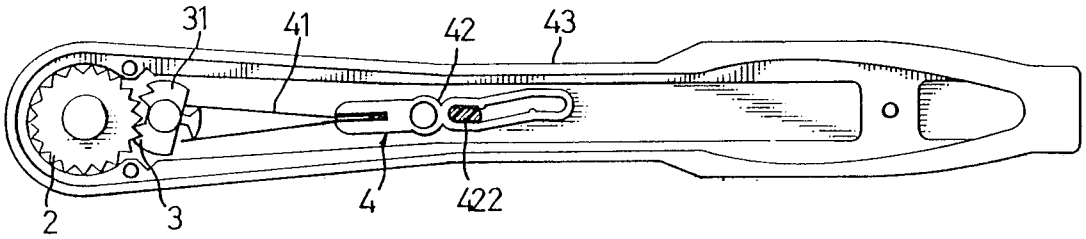
FIG. 3 is a top view of the control device of FIG. 1 showing the state wherein the ratchet wheel can only transmit torque in the clockwise (CW) direction.

Referring to FIG. 1 through FIG. 3, it can be seen that a ratchet wrench 10 in accordance with the present invention comprises a housing 1 receiving a ratchet wheel 2, a pawl 3 and a control device 4. The ratchet wheel 2 is disposed in the front portion of the housing 1. The pawl 3 is pivotably arranged adjacent to and contacting with the ratchet wheel 2. As shown in FIGS. 2 and 3, the control device 4 urges the pawl 3 to engage with and lock with the ratchet wheel 2 with a first tooth 31 or a second tooth 32, so that the ratchet wheel 2 can transmit torque either in the CCW direction (as seen in FIG. 2) or in the CW direction (as seen in FIG. 3). The reverse direction of the ratchet wheel 2 rotates freely. In other words, the control device controls the rotational direction (CW or CCW) of torque transmission.

The control device 4 comprises a resilient sheet 41, a control element 42 and a button 43. One end of the resilient sheet 41 engages with the rear end of the pawl 3. The other end of the resilient sheet 41 is received in an opening 421 formed at the front end of the control element 42. The rear portion of the control element 42 is a curved arm with a groove 422 therein. The control element 42 is pivotally received in a middle portion the housing 1. The button 43 has a pin 431 inserting into the groove 422 of the control element 42 through a slot 111 formed in the upper surface 11 of the housing 1.

When the button 43 is pushed to a rear position, the resilient sheet 41 forces the pawl 3 to engage and lock the ratchet wheel 2 with the first tooth 31, so that the ratchet wheel 2 can transmit rotational torque when the wrench rotates in the CCW direction and so that the ratchet wheel 2 freely rotates when the wrench rotates in the CW direction, as shown in FIG. 2.

When the button 43 is pushed to the front position, the resilient sheet 41 forces the pawl 3 to engage and lock the ratchet wheel 2 with the second tooth 32, so that the ratchet wheel 2 transmits torque when a load is applied to the wrench and the wrench is and rotated in the CW direction. When the wrench is rotated in the CCW direction, as shown in FIG. 3, the ratchet wheel 2 freely rotates.

Figure 4:
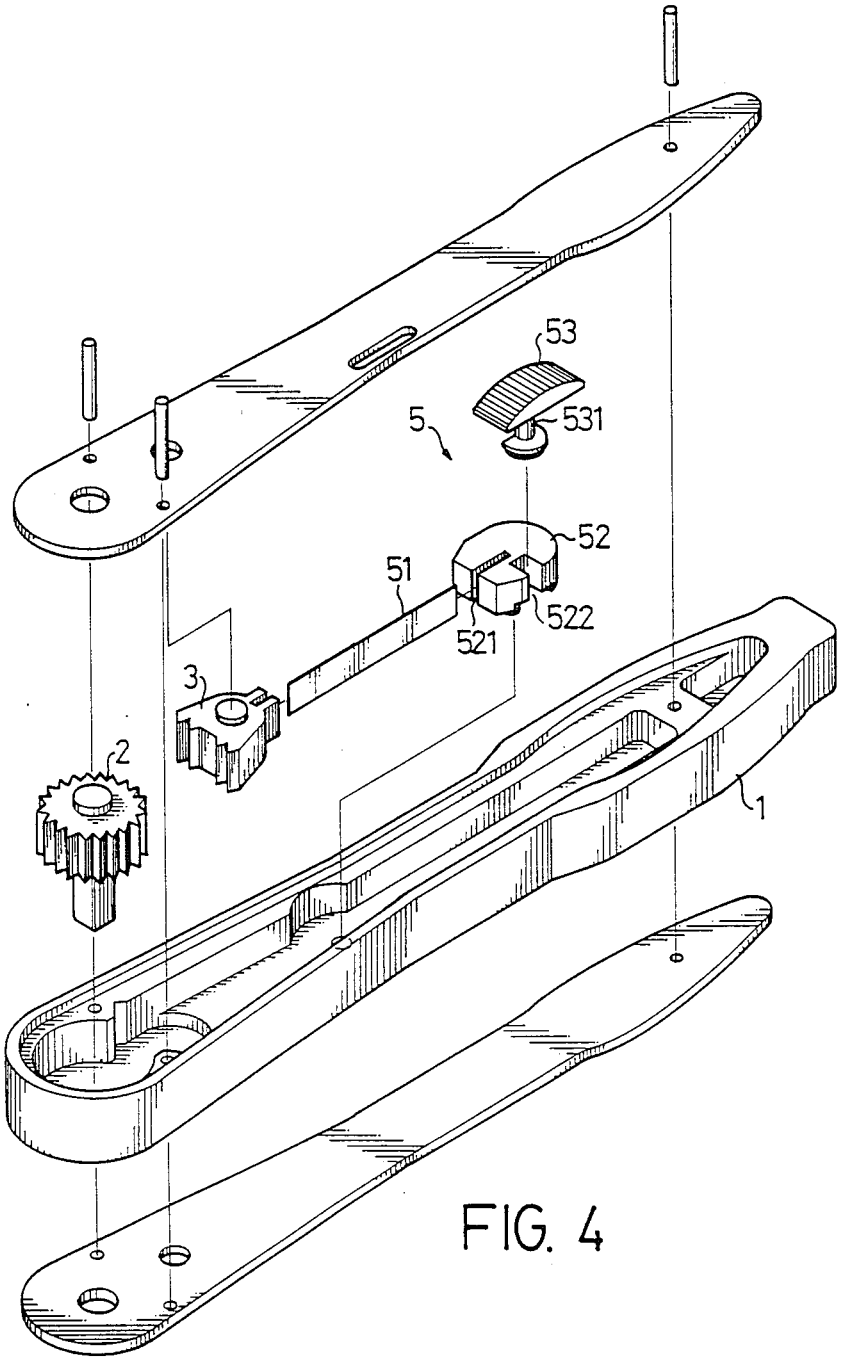
FIG. 4 is an exploded view of a second embodiment of the control device for ratchet wrenches in accordance with the present invention.
Figure 5:
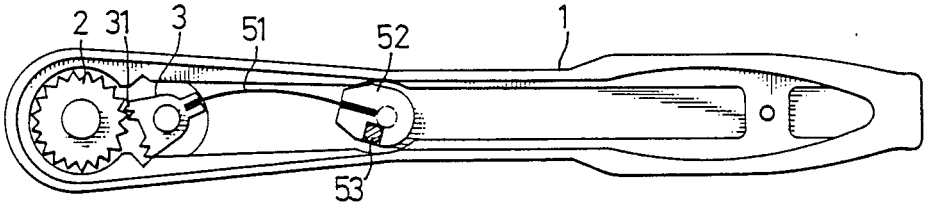
FIG. 5 is a top view of the control device of FIG. 4 showing the state wherein the ratchet wheel can only transmit rotational torque in the CCW direction.
Figure 6:
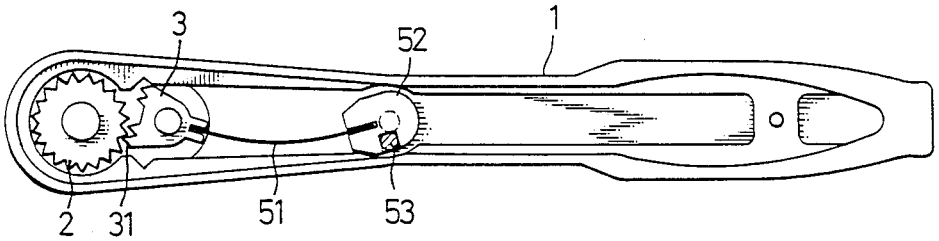
FIG. 6 is a view of the control device of FIG. 4 showing the state wherein the ratchet wheel can only transmit torque in the CW direction.

A second embodiment of the control device is shown in FIGS. 4 through 6. The control device 5 comprises a resilient sheet 51, a control block 52 and a button 53. One end of the resilient sheet 51 is inserted into the rear end of the pawl 3. The other end of the resilient sheet is inserted into an opening 521 on the front end of the control block 52. The control block 52 is pivotally disposed in the housing 1. The control block 52 has a notch 522 at the side, approximately at a 90 degrees angle from the opening 521 portion. The button 53 comprises a pin 531 inserting into the notch 522 through a slot formed in the upper surface of the housing and engaging with the control block 52 with the lower end thereof.

As shown in FIGS. 5 and 6, when the button 53 is pushed to the front position or rear position, the resilient sheet 51 forces the pawl 3 to engage with the ratchet wheel 2 with the first second teeth 31 and 32 thereof, respectively. Therefore the ratchet wheel 2 can only transmit torque in one direction while it freely rotates in the opposite direction.

Figure 7:
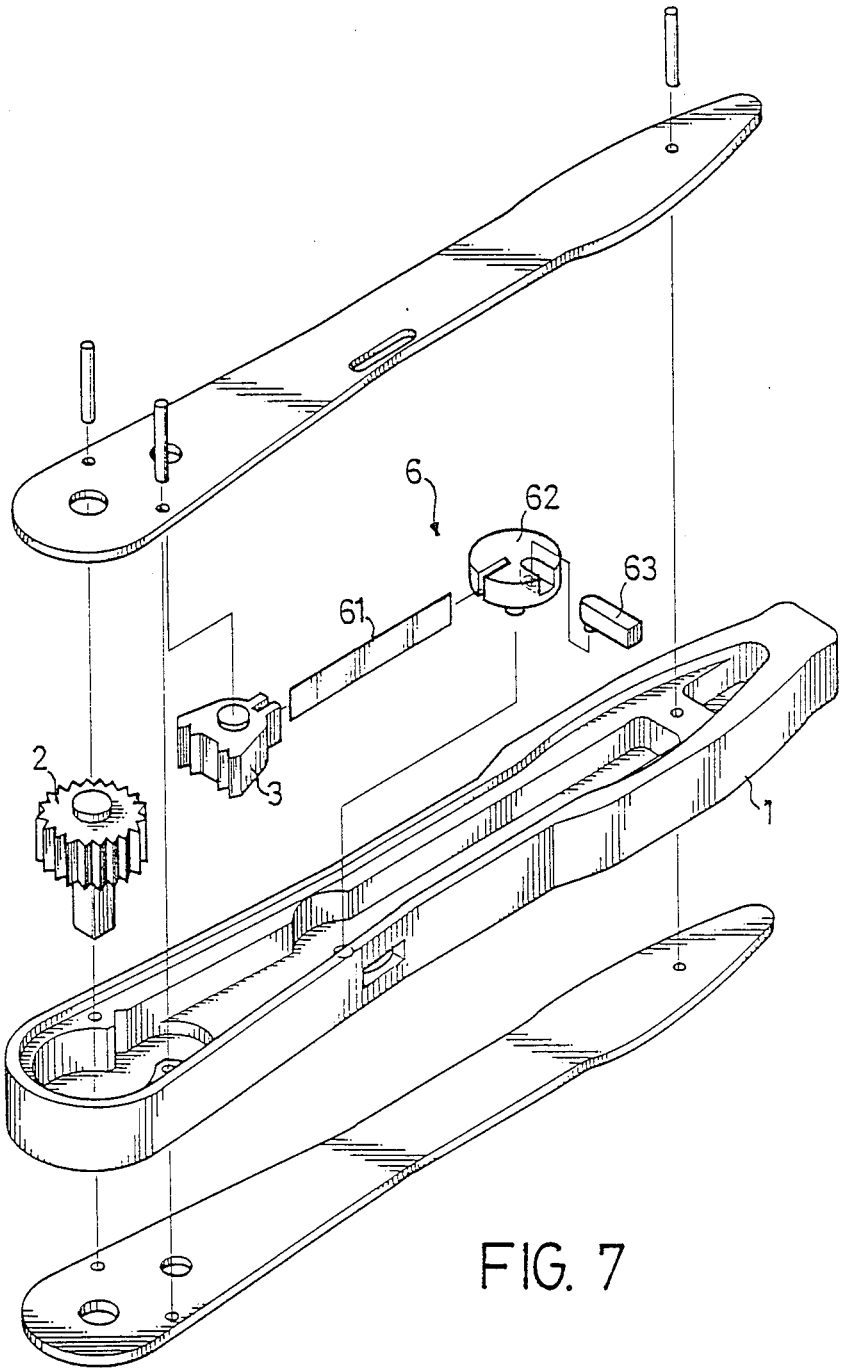
FIG. 7 is an exploded view of a third embodiment of the control device for ratchet wrenches in accordance with the present invention.
Figure 8:
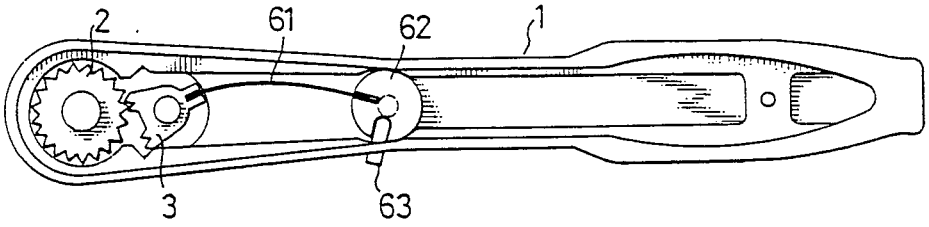
FIG. 8 is a cross-sectional view of the control device of FIG. 7 showing the state wherein the ratchet wheel can only transmit torque in the CCW direction.
Figure 9:
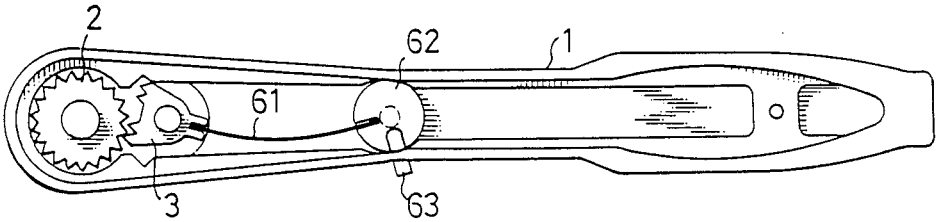
FIG. 9 is a cross-sectional view of the control device of FIG. 7 showing the state wherein the ratchet wheel can only transmit torque in the CW direction.
Figure 10:
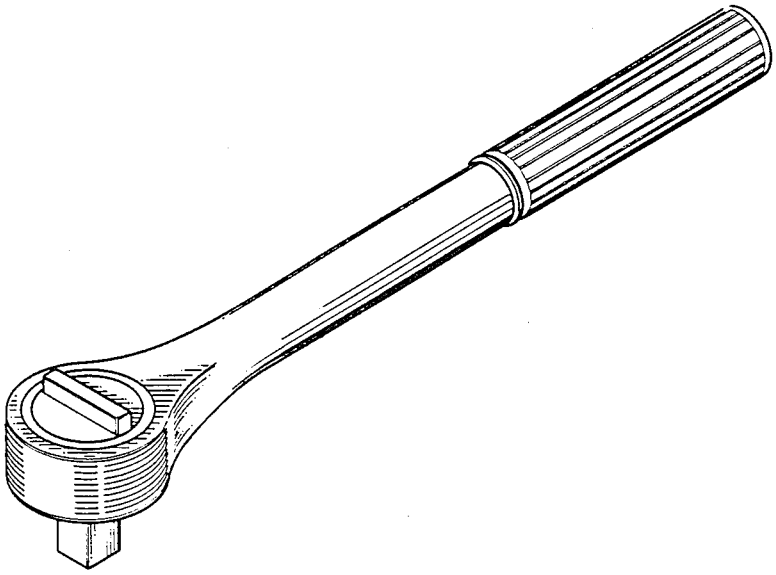
FIG. 10 PRIOR ART
FIG. 10 shows a conventional ratchet wrench with a control device disposed above the ratchet wheel.

Referring to FIGS. 7 through 9, a third embodiment of the control device in accordance with the present invention. The control device 6 comprises a resilient sheet 61, a control block 62 and a button 63. The control device 6 is similar to the second embodiment of the control device 5 except that the button 63 projects through a side wall of the housing.

The buttons of the three embodiments of the present invention are disposed at the middle portion of the housing, so that the operator can easily change the desired torque transmitting direction with one operating hand.

As various possible embodiments might be made of the above invention without departing from the scope of the invention, it is to be understood that all matter herein described or shown in the accompanying drawings is to be interpreted as illustrative and not in a limiting sense. Thus it will be appreciated that the drawings are only exemplary of preferred embodiments of the invention.

I claim:

1. A control device for ratchet wrenches which is received in a housing of a ratchet wrench and which urges a pawl to engage with and lock with a first or a second tooth of a ratchet wheel, said control device controlling the direction of torque transmission, said control device comprising:

a resilient sheet engaging with a rear end of said pawl at one end thereof;

a control element being pivotally received in a middle portion of said housing and having an opening to receive another end of said resilient sheet and a curved arm with a groove; and a button having a pin which is insertable in and slidable in said groove of said control element.

2. A control device for ratchet wrenches as claimed in claim 1, wherein said button projects through an upper surface of said housing.

* * * * *